US006183318B1

(12) United States Patent
Tsumiyama et al.

(10) Patent No.: US 6,183,318 B1
(45) Date of Patent: Feb. 6, 2001

(54) REVERSER FOR WATERCRAFT

(75) Inventors: Yoshinori Tsumiyama, Miki; Kenichi Nakagawa, Kobe; Tomohiro Kanazawa, Amagasaki; Masafumi Ikeyama, Kobe, all of (JP)

(73) Assignee: Kawasaki Jukogyo Kaisha, Kobe (JP)

( * ) Notice: Under 35 U.S.C. 154(b), the term of this patent shall be extended for 0 days.

(21) Appl. No.: 09/469,563

(22) Filed: Dec. 22, 1999

(30) Foreign Application Priority Data

Dec. 28, 1998 (JP) ..... 10-373890

(51) Int. Cl.[7] ..... B63H 11/11
(52) U.S. Cl. ..... 440/41; 440/38
(58) Field of Search ..... 440/38, 41

(56) References Cited

U.S. PATENT DOCUMENTS 5,752,864 * 5/1998 Jones et al. ..... 440/41
5,934,954 * 8/1999 Schott et al. ..... 440/41

OTHER PUBLICATIONS

Japanese Publication Number JP HEI 1–273785 Dated Nov. 1, 1989, Patent Abstracts of Japan.
Japanese Publication Number JP UM HEI 5–13677 Dated Dec. 4, 1993.

* cited by examiner

*Primary Examiner*—Jesus D. Sotelo

(57) ABSTRACT

It is an object to provide a reverser for a watercraft which has a high go astern efficiency and also functions as a side thruster while holding planing performance. In a reverser (1) for a watercraft in which a deflector (1A) is movably provided behind a pump nozzle of a water jet pump (P) to change the direction of water flow ejected rearward from the pump nozzle, thereby allowing the body (A) to go in reverse, a discharge port (1*a*) which directs the water flow in a transverse direction is provided on both side portions of the deflector (1A), thereby feeding the water flow from the discharge port (1*a*) along a transom (T) of the body (A).

14 Claims, 10 Drawing Sheets

REVERSER FOR WATERCRAFT

BACKGROUND OF THE INVENTION

1. Field of the Invention

The invention relates to a reverser for a watercraft which allows the watercraft to go astern.

2. Description of the Related Art

A watercraft which is propelled by a water jet pump, for example, a personal watercraft (which is also referred to as a "PWC") has such a structure as to suck water (including sea water) through a water intake hole provided on the bottom of a hull, to pressurize the water by the water jet pump and to eject the water rearward from the hull through an outlet port of the water jet pump, thereby advancing the PWC.

To go in reverse, a deflector liftably (movably) provided behind the steering nozzle is positioned in a portion behind the steering nozzle (brought down), thereby changing the direction of the water flow ejected rearward from the steering nozzle into a forward direction. Thus, the watercraft can go in reverse.

As described in Japanese Utility Model Publication No. Hei 5-13677 (U.S. Pat. No. 4,708,671), a reverser for a watercraft according to the prior art comprises a deflector having a lower end which can be positioned below the bottom in a reverse state and having a semibowl-shaped inner face. By the shape of the inner face and the position of the lower end of the deflector, the direction of the water flow discharged rearward from the pump nozzle is changed such that the water flow is ejected forward in a region under the bottom.

With such a structure, if the reverser is to function effectively, it is necessary that the water flow should be smoothly ejected forward from the lower end of the deflector along the bottom face of a rear end of the watercraft body which is hollowed out slightly upward.

However, the bottom face of the rear end of the body is significant in enhancing planing performance when the watercraft is going forward. It is desirable that this portion should form a rectilinear bottom face as continuously as possible from a forward region thereof.

SUMMARY OF THE INVENTION

In consideration of the forgoing circumstances, it is an object of the invention to provide a reverser for a watercraft which has a high reverse efficiency and can function as a side thruster and additionally has high planing performance.

A first aspect of the invention is directed to a reverser for a watercraft in which a deflector is movably provided behind a pump nozzle of a water jet pump to change the direction of water flow ejected rearward from the pump nozzle, thereby moving the watercraft rearward, wherein a discharge port opened in a transverse direction is provided on both side portions of the deflector, thereby feeding the water flow from the discharge ports along a transom of the body of the watercraft.

According to the reverser for a watercraft of the invention which has the above-mentioned structure, the water positioned adjacent to a transom portion of the body flows toward the side end of the body along the transom of the body by the water flow ejected from the discharge port. By the movement of the water, the water pressure is lowered in a region behind the body (behind the transom). Consequently, the body can move sternway. More specifically, while the conventional reverser positively discharges the water forward to move the body rearward, the reverser according to the invention moves the water positioned behind the body toward the side end of the body to form a portion having a low water pressure, thereby moving the body rearward. According to the invention, it is possible to provide a reverser having a good rearward moving efficiency while maintaining planing performance.

In the reverser for a watercraft, if an inner face of the deflector includes a wall portion vertically extended in the center thereof, and a deflecting curved face is provided on both sides of the wall portion for deflecting the water flow ejected rearward into a transverse direction, it is possible to obtain an excellent structure in that the water flow is directed smoothly and uniformly toward both sides in reverse.

Furthermore, the reverser is provided with steering means such as a steering nozzle for being swung to the right and left sides which will be described below. Consequently, left side or right side steering of the watercraft can effectively be performed while going in reverse.

In the reverser for a watercraft, furthermore, if a guide face for smoothly leading the water flow to the discharge port is formed on the inner face of the deflector from the deflecting curved face toward the discharge port turned in the transverse direction, the water flow can smoothly be directed from the wall portion to the discharge port.

In the reverser for a watercraft, moreover, if the discharge port is turned toward a transom side of the body at an angle of about 5 to about 30 degrees as seen in a plane view, it is possible to obtain an effective structure for forming water flow along the transom.

In the reverser for a watercraft, furthermore, if a lower end of the deflector has a partially circular shape as seen from a side and the discharge port is provided in a position from middle portions of both side portions of the deflector toward the lower end thereof, the water flow discharged from the discharge port is pressed downward by the upper water and is discharged (ejected) toward the side (in a transverse direction) because the discharge port fully sinks into the water. Therefore, the discharged energy is not directed toward the water surface but effectively flows along the transom.

In the reverser for a watercraft, moreover, if a fairing fin horizontally extended in reverse state is projected onto the inner face of the deflector, the water flow ejected from the steering nozzle is prevented from being deflected into a vertical direction and is smoothly directed toward a discharge port side:

In the reverser for a watercraft, furthermore, if a steering nozzle capable of being moved in a transverse direction is provided between the pump nozzle of the water jet pump and the deflector, an optional amount of the water flow can be discharged from an optional discharge port provided on both sides of the deflector, thereby performing steering while in reverse. In addition, the reverser can also be caused to function as a side thruster.

In the reverser for a watercraft, moreover, if both comer portions of a rear end of the watercraft provided with the deflector are round-shaped as seen in a plane view, the water flow fed toward the side along the transom can positively form a water flow to be fed from the transom to the forward portion of the body along side face of the body. Consequently, a reverser having high reverse efficiency is obtained.

These objects as well as other objects, features and advantages of the present invention will become more apparent to those skilled in the art from the following description with reference to the accompanying drawings.

DETAILED DESCRIPTION OF THE PREFERRED EMBODIMENT

A reverser for a watercraft according to an embodiment of the invention will be described below with reference to the drawings by taking, as an example, the case where the reverser is used for a personal watercraft.

Figure 1:
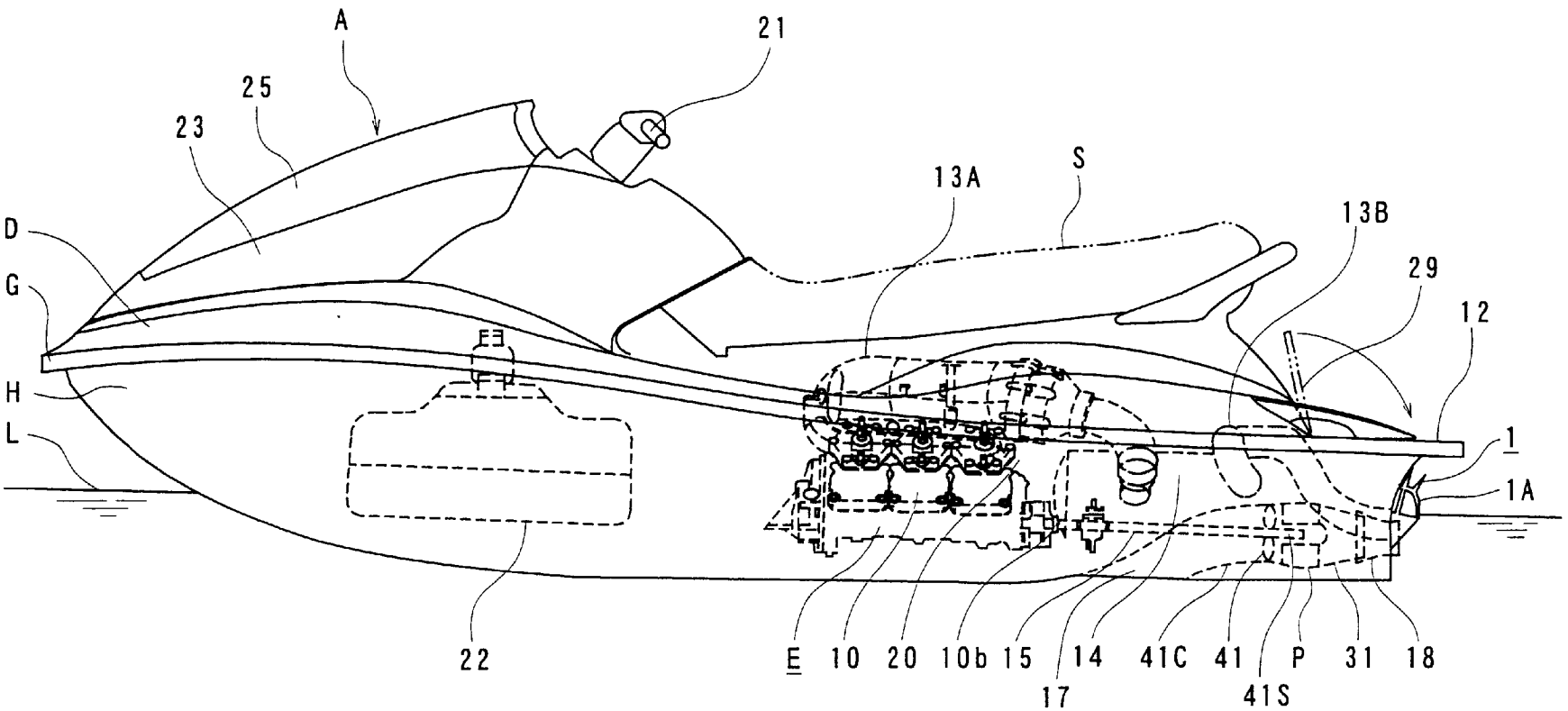
FIG. 1 is a side view showing a personal watercraft providing a reverser according to an embodiment of the invention.
Figure 2:
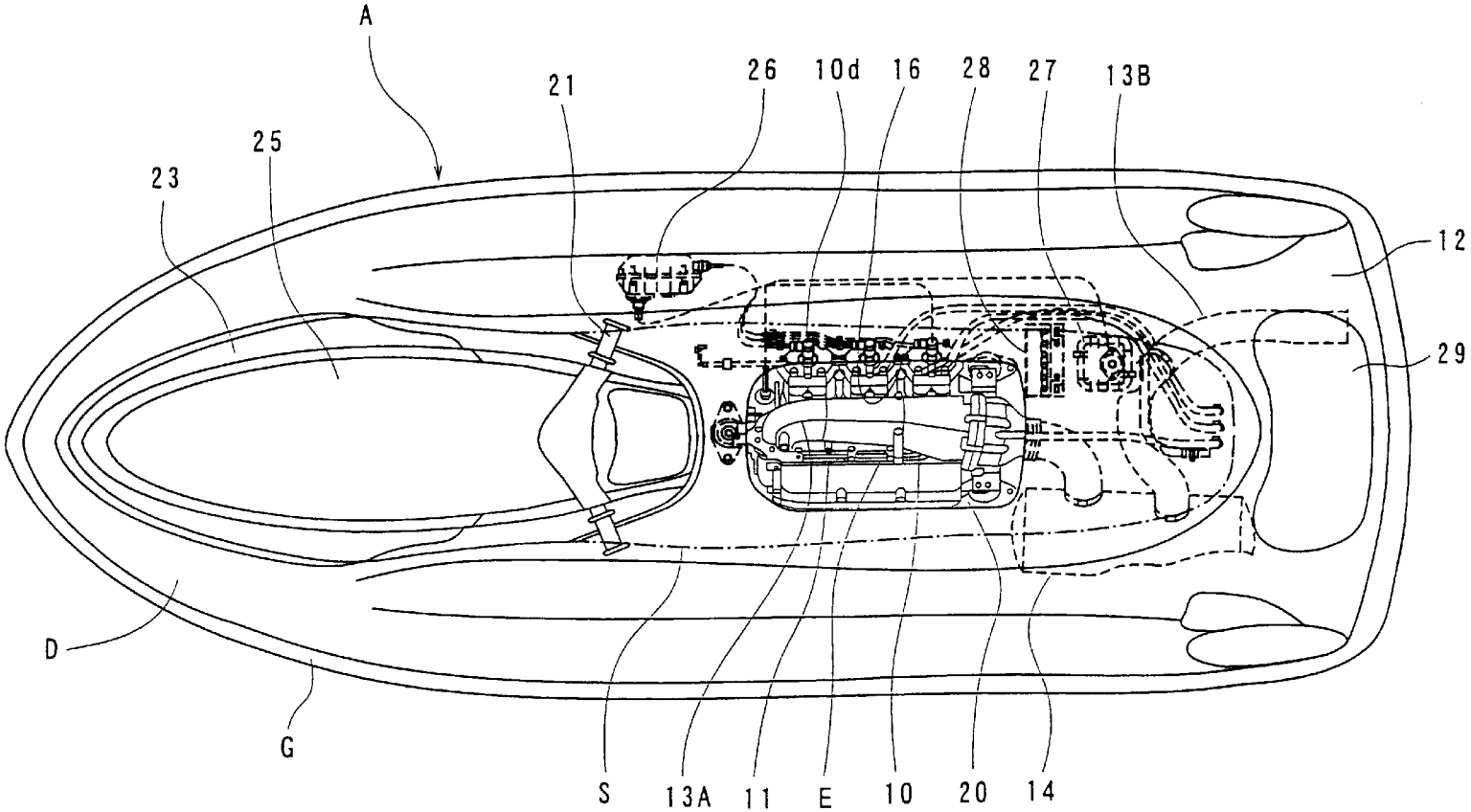
FIG. 2 is a plan view showing the personal watercraft illustrated in FIG. 1.

In FIGS. 1 and 2, A denotes a body of the personal watercraft. The body A comprises a hull H and a deck D covering an upper portion of the hull H. A line for connecting the hull H to the deck D over the entire periphery is referred to as a gunwale line G. In the illustrated embodiment, the gunwale line G is positioned above a waterline L of the personal watercraft.

An opening 16 having a top face almost rectangular as seen in a plane view along the longitudinal direction of the body A is formed slightly behind the center of the deck D as shown in FIG. 2. As shown in FIGS. 1 and 2, a riding seat S is provided above the opening 16.

An engine E is provided in a space (referred to as an "engine space") 20 having a convex cross-sectional shape surrounded by the hull H and the deck D below the seat S.

Figure 3:
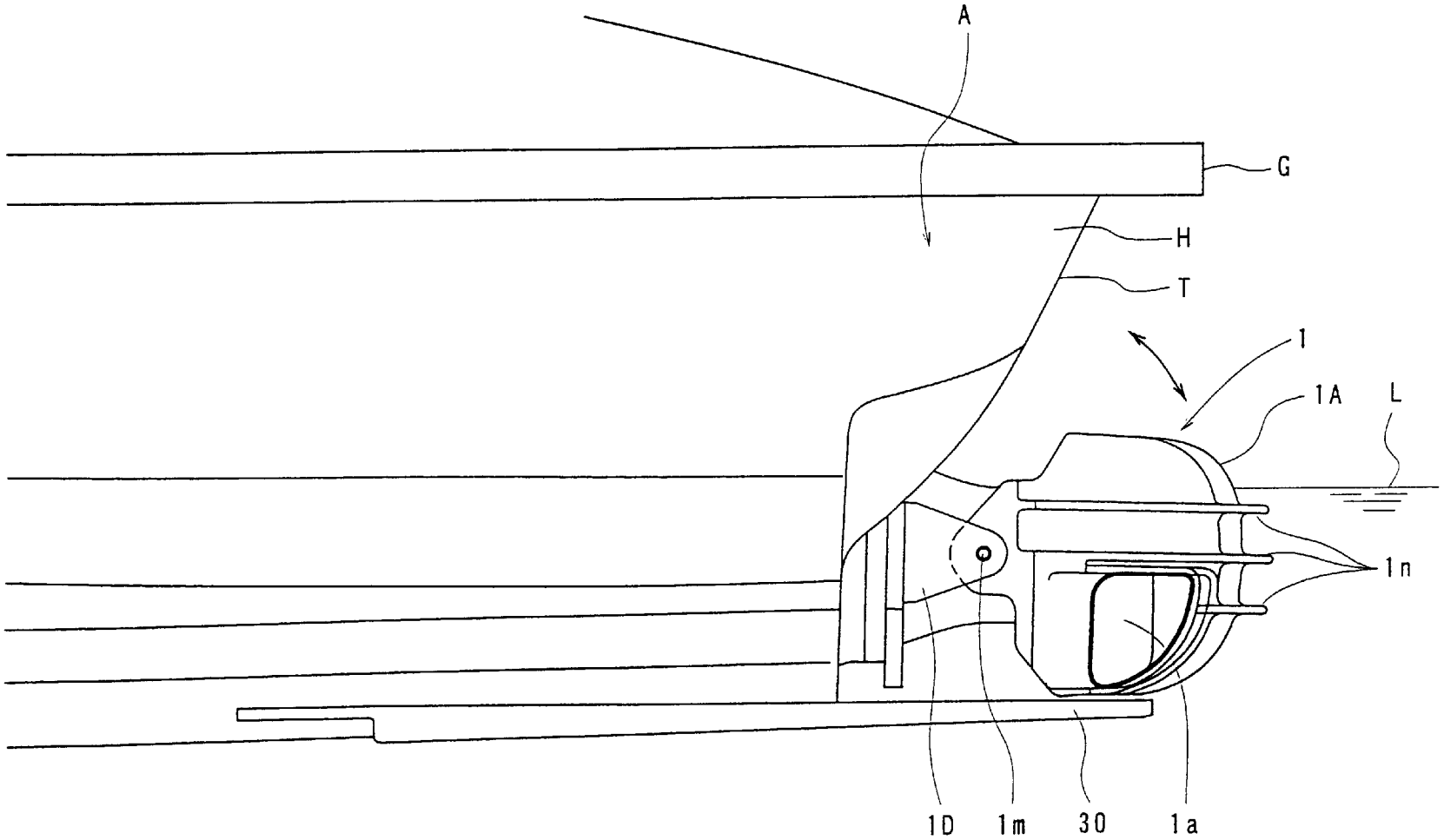
FIG. 3 is a partially enlarged side view showing the structure of a side configuration of a deflector brought down and a stem portion of the personal watercraft illustrated in FIGS. 1 and 2.

The engine E is a multi-cylinder (three-cylinders in the embodiment) engine. As shown in FIG. 1, a crankshaft 10*b* of the engine E is mounted in the longitudinal direction of the body A. As shown in FIG. 2, a carburetor 11 and an air intake chamber (not shown) connected thereto are provided on the left side of an engine block 10 (the port side, or left board of the personal watercraft). As shown in FIGS. 1 and 2, an exhaust pipe 13A is provided above the engine block 10. The exhaust pipe 13A is connected to a silencer 14 provided at the oblique left side portion behind the engine block 10. An exhaust pipe 13B having a terminal reaching the outside of the rear end of the body A from the silencer 14 is provided above a water jet pump P. As shown in FIGS. 1 and 3, an output end of the crankshaft 10b projecting from the rear portion of the engine block 10 is rotatably coupled integrally with the tip portion of an impeller 41 of the water jet pump P through a propeller shaft 15. Furthermore, the rear end portion of the impeller 41 is coupled integrally with a pump shaft 41S of the water jet pump P. The impeller 41 is covered with a pump casing 41C on the outer periphery thereof. The water pump P sucks water from a water intake (water feeding port) 17 provided on the bottom of hull through a water intake passage, and pressurizes and accelerates the water. The pressurized and accelerated water is ejected from an outlet port provided on the rear end of a pump nozzle 31 having a cross-sectional area of flow gradually reduced rearward, thereby obtaining propulsive force. In FIGS. 1 and 2, the reference numeral 21 denotes a steering handle. By operating the handle 21 right and left, a steering nozzle 18 provided behind the pump nozzle 31 is swung from the right side to the left side so that steering can be performed in a desired direction. A deflector 1A for reverse (see FIG. 1) is provided with the body A through a fixture member 1D (see FIG. 3) above the rear side of the steering nozzle 18 such that it can be swung downward around a swinging shaft 1*m* (see FIG. 3) provided horizontally. The bowl-shaped deflector 1A swings down toward a lower position behind the steering nozzle 18 by operating a deflector operation lever (not shown) provided in the vicinity of the driving seat of a personal watercraft, the water to be discharged rearward from the steering nozzle 18 is turned in a lateral direction. Consequently, the personal watercraft can go in reverse.

Figure 5:
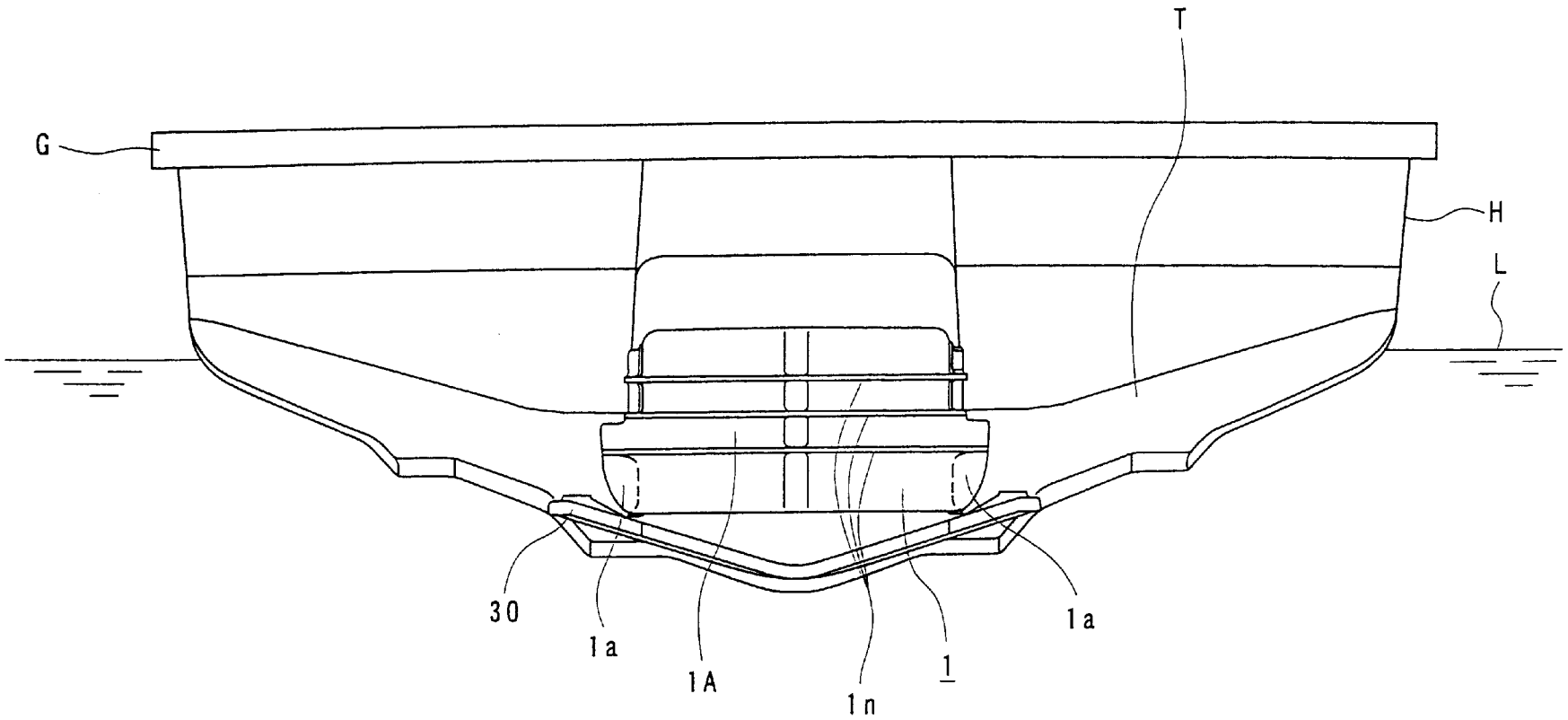
FIG. 5 is an enlarged rear view showing the personal watercraft providing the reverser of the stem portion of the personal watercraft in FIGS. 1 and 2 brought down.
Figure 10:
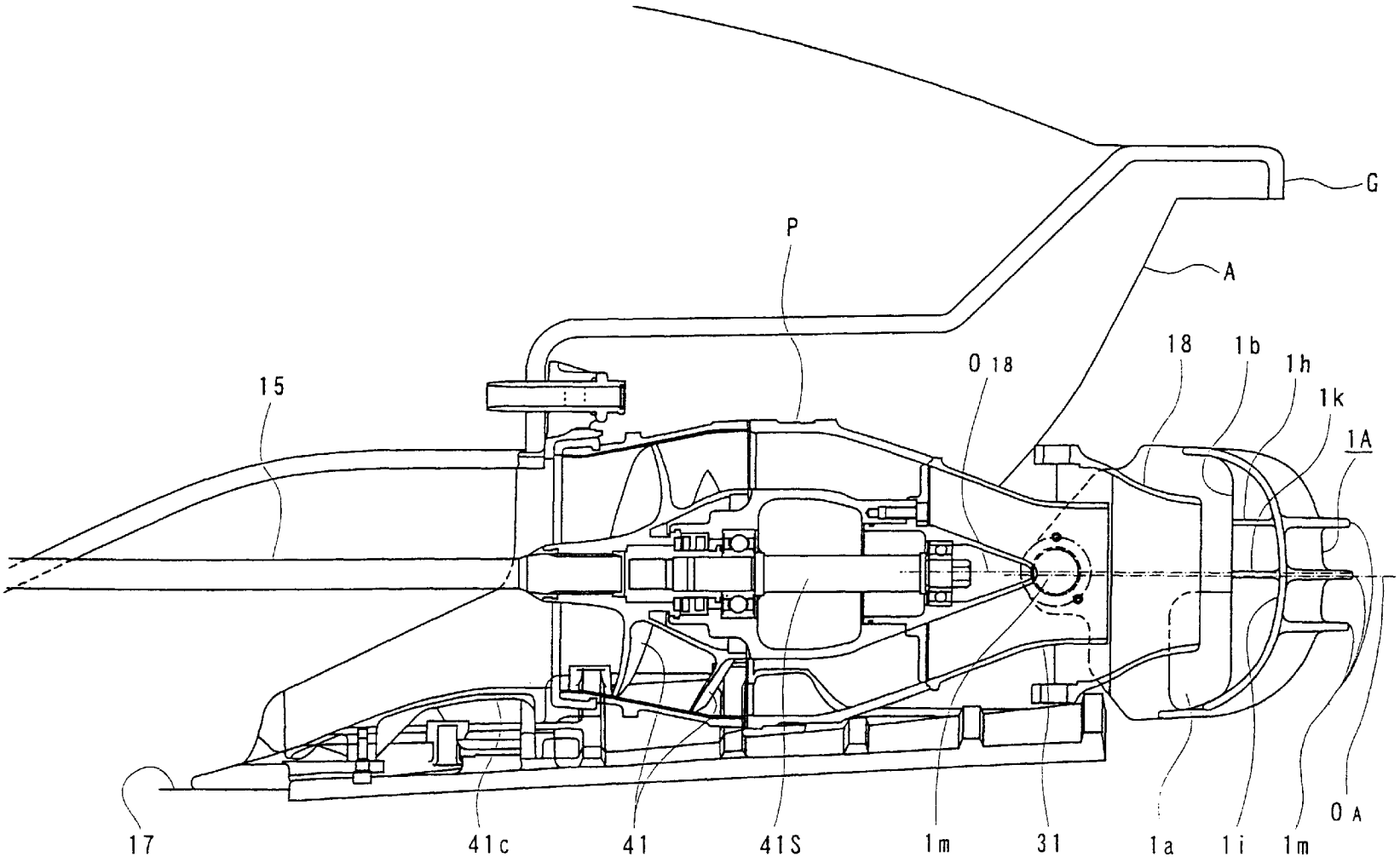
FIG. 10 is an enlarged rear view showing the structure of the rear face of the deflector illustrated in FIG. 5.

In the reverser 1 according to the embodiment, in a state in which the deflector 1A is swung upward (raised) around the swinging shaft 1*m* (see FIG. 3), it is positioned over the water surface as shown in FIG. 1. On the other hand, in a state in which the deflector 1A is swung downward (brought down), the lower end thereof is positioned slightly above the bottom of the body A as shown in FIGS. 3, 5 or 10.

In FIGS. 1 and 2, the reference numeral 12 denotes a rear deck. The rear deck 12 is provided with an openable hatch cover 29. A housing box having a small capacity is formed under the hatch cover 29. In FIG. 1, the reference numeral 22 denotes a fuel tank for supplying a fuel to the engine E, and the reference numeral 23 denotes a front hatch cover. A box (not shown) for housing fittings and the like is provided under the hatch cover 23. Another hatch cover 25 is provided over the front hatch cover 23, thereby forming a double hatch cover. A life jacket and the like can be housed under the hatch cover 25.

In FIG. 2, the reference numeral 26 denotes an ignition device for supplying high voltage electricity to an ignition plug 10*d* of the engine E in proper timing, the reference numeral 27 denotes an oil tank, and the reference numeral 28 denotes a battery.

Figure 4:
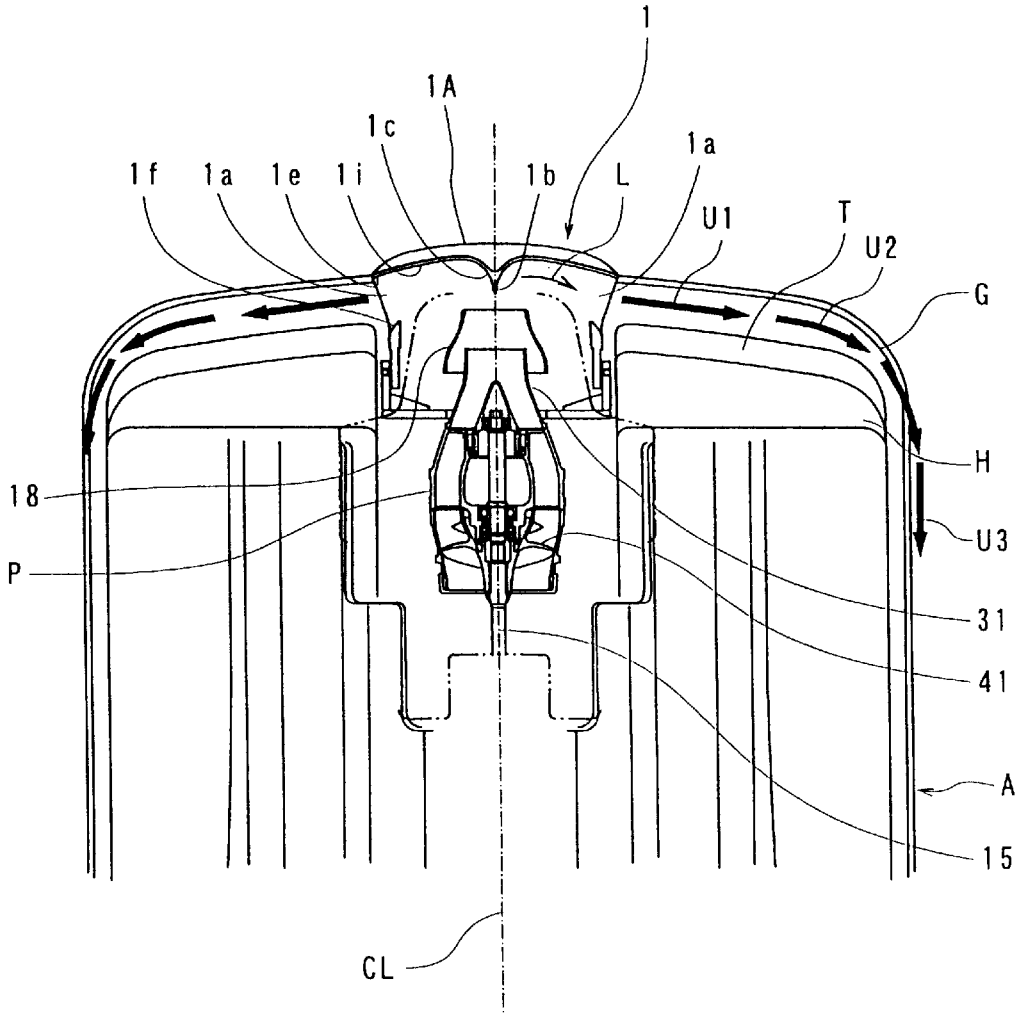
FIG. 4 is a partially enlarged bottom view being taken away with a bottom of the corresponding portion and cutting off the deflector and a water jet pump partially showing the structure of the deflector brought down, the water jet pump, the stem portion, and a transom of the personal watercraft illustrated in FIGS. 1 and 2.
Figure 8:
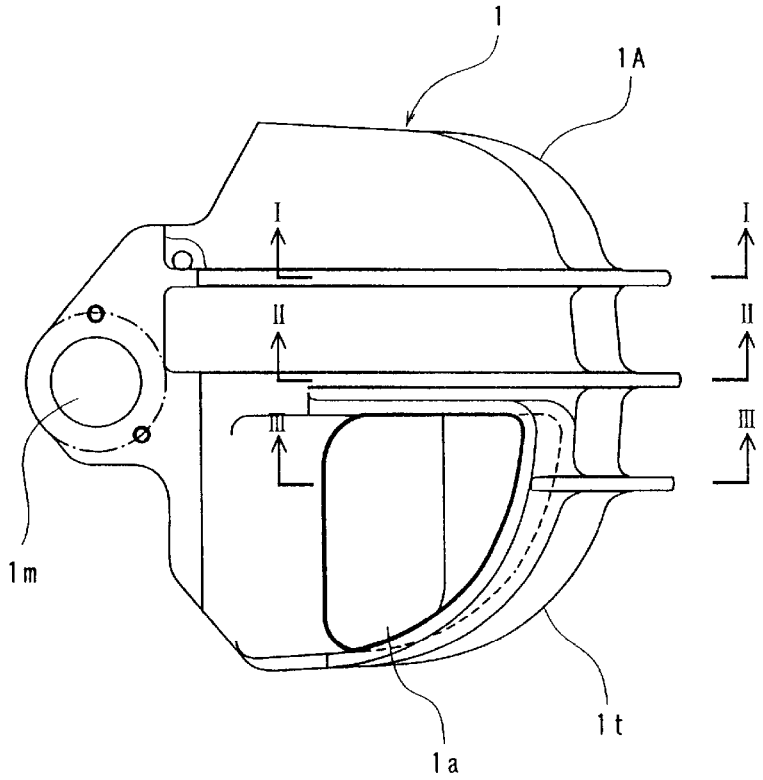
FIG. 8 is an enlarged side view showing the structure of a side face of the deflector illustrated in FIGS. 1 to 5.

The reverser 1 according to the embodiment of the invention has the following structure: the deflector 1A constituting the reverser 1 has an almost semibowl shape (like an American football helmet) in a side view as shown in enlarged views of FIGS. 3 and 8. In other words, a lower half portion it of the rear side of the deflector 1A has a partially circular shape as seen from the side. As seen from the side view, a discharge port 1*a* is formed in the partially circular lower half portion 1*t* of the deflector 1A on the right and left sides (in a transverse direction) of the deflector 1A. As shown in FIG. 4, the discharge port 1*a* has such a structure that the opening direction is almost parallel with a transom T of a body A. In the embodiment, as seen in a plane view, the transom T is tilted forward at an angle of about 5 to about 8 degrees on the right and left sides toward both ends with respect to a line (a virtual line orthogonal to the longitudinal direction of the body A which is not shown) orthogonal to a centerline CL of the body A, and the discharge port 1*a* is also tilted forward at an angle of about 10 to about 13 degrees. More specifically, the discharge port 1*a* is turned toward the transom T side of the body A at an angle of about 5 degrees as seen in a plane view in the embodiment. However, even if the angle is substantially 0 degree with respect to the transom T, basic effects can be obtained. Moreover, the angle may be about 45 degrees, and more preferably, about 5 to about 30 degrees.

As shown in FIGS. 4 and 5, the discharge port 1*a* is in a position where both ends of the deflector 1A are projected most.

Figure 6:
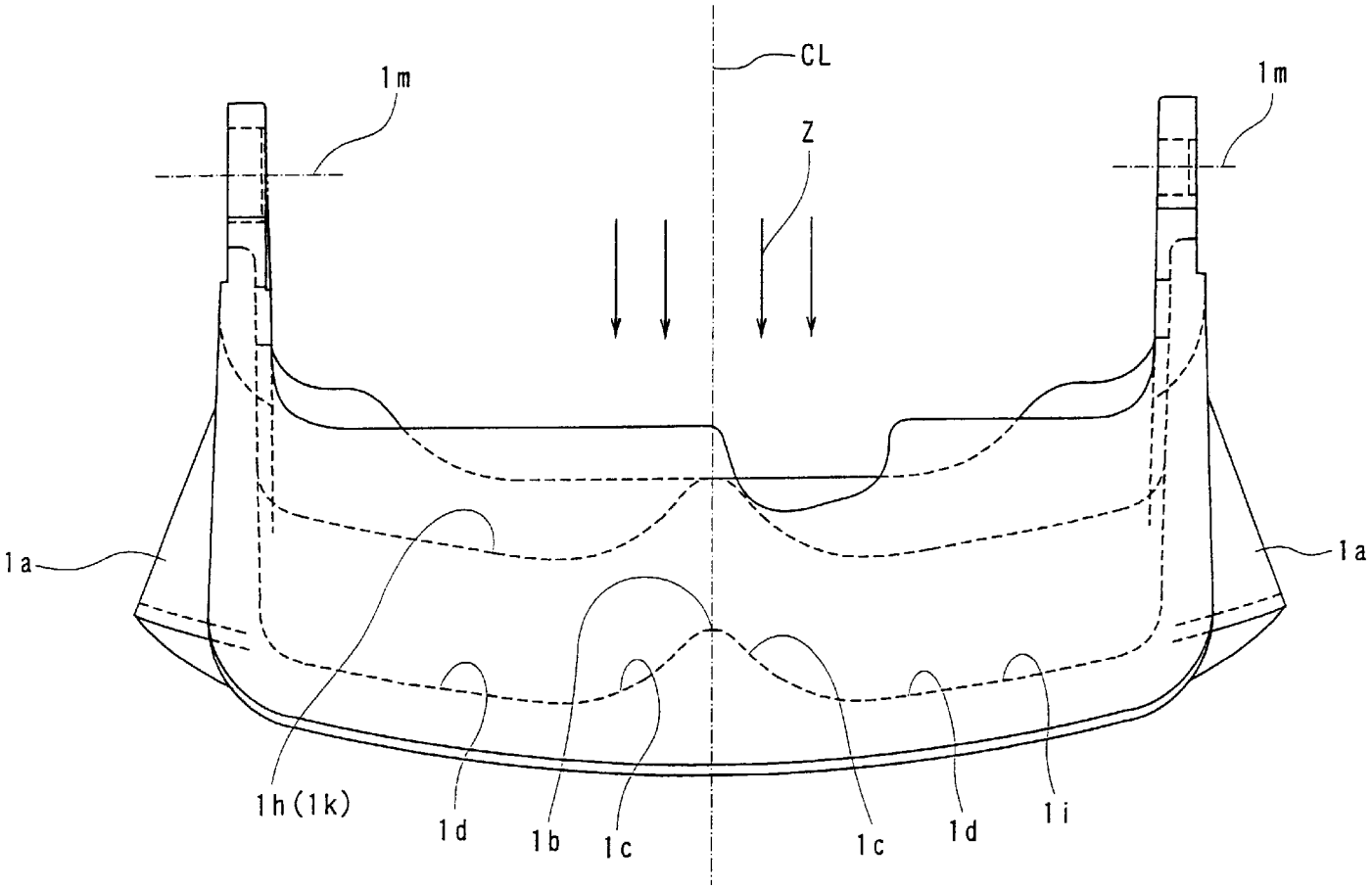
FIG. 6 is an enlarged plan view showing the structure of the deflector illustrated in FIGS. 1 to 5.
Figure 7:
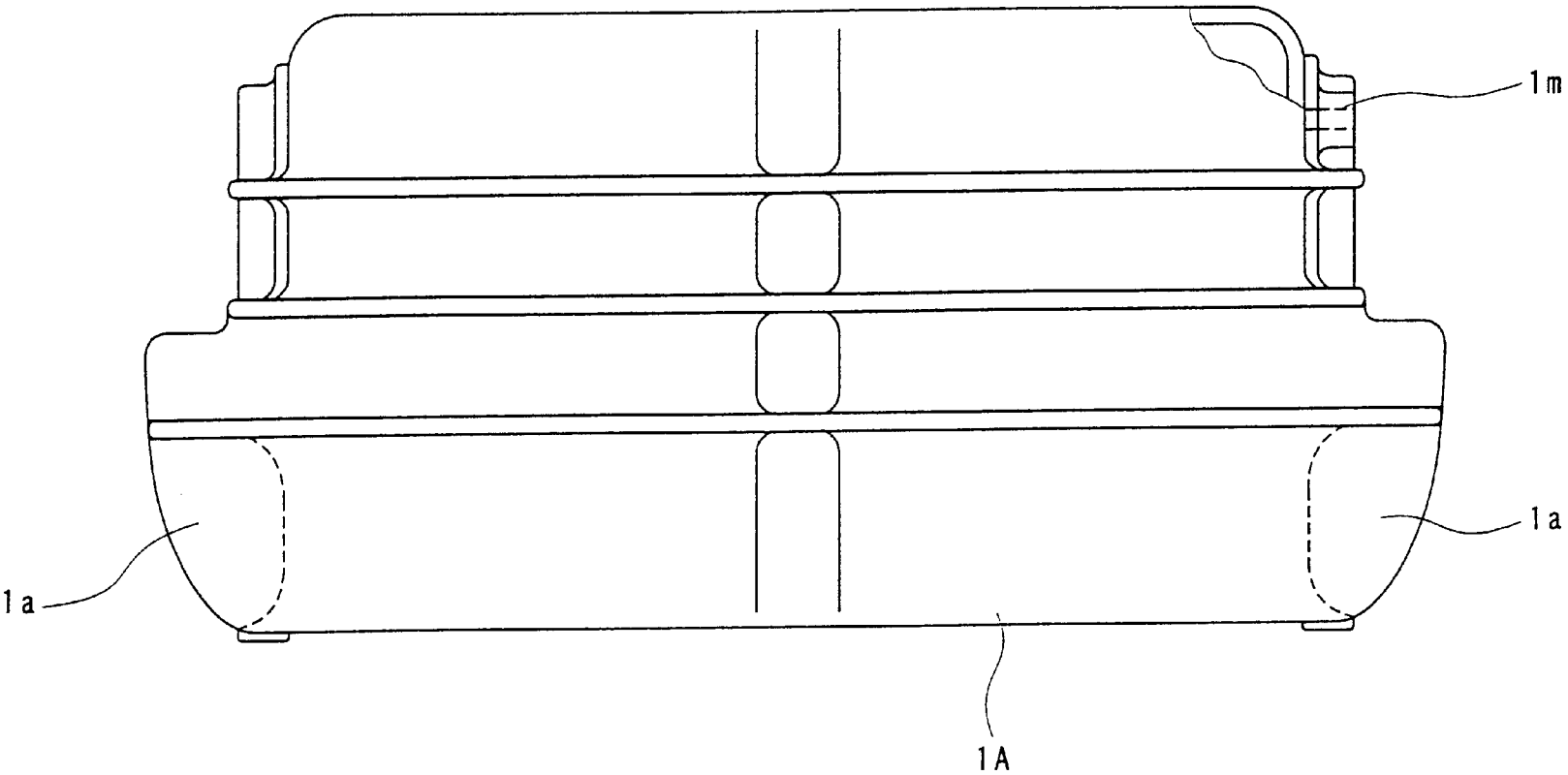
FIG. 7 is an enlarged rear view showing the structure of a rear face of the deflector illustrated in FIGS. 1 to 5.
Figure 9A:
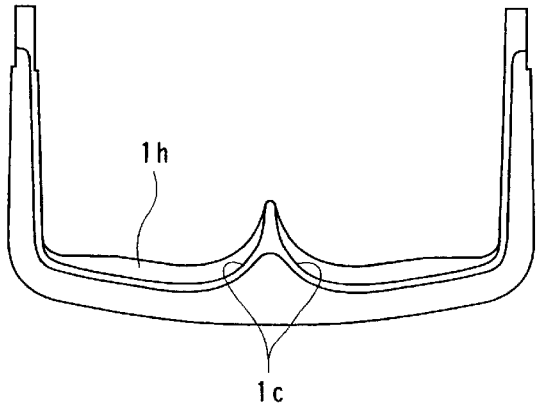
FIGS. 9A to 9C is a view showing a sectional shape of each portion of the deflector, FIG. 9A being a sectional view taken along the line I—I in FIG. 8, FIG. 9B being a sectional view taken along the line II—II in FIG. 8, and FIG. 9C being a sectional view taken along the line III—III in FIG. 8.
Figure 9B:
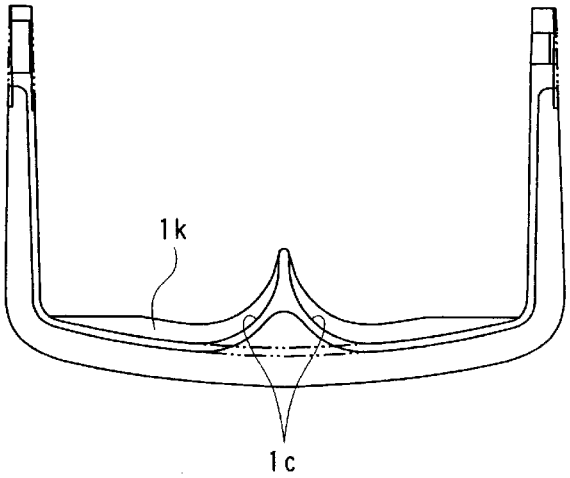
Figure 9C:
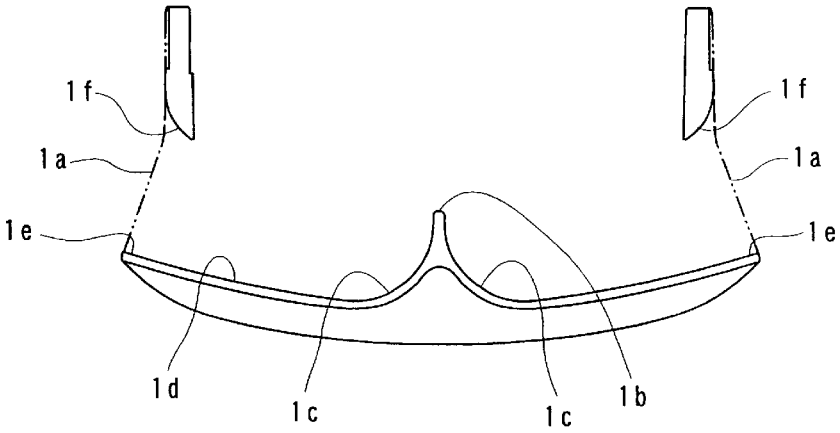

As shown in FIG. 4 seen from a bottom side and FIG. 5 illustrating the body A seen from a rear side, the deflector 1A has a shape extended in the transverse direction of the body A and includes a wall portion 1*b* vertically formed in the center of an inner face 1*i* of the deflector 1A which is coincident with the centerline CL of the body A. The height of the wall portion 1*b*, that is, the length of projection toward the body A side, is as close to the rear end of the steering nozzle 18 as possible such that the transverse swinging operation of the steering nozzle 18 is not obstructed. Moreover, the wall portion 1*b* is sharp on the tip side thereof and is provided with a deflecting curved face 1*c* for deflecting the water ejected rearward toward the side (in the transverse direction) by utilizing side faces on both sides of the wall portion 1*b*. As shown in FIG. 6, which is a plane view of the deflector 1A, or in FIGS. 9A to 9C illustrating the shape of each of upper and lower portions of the deflector 1A, the deflecting curved face 1*c* has a shape which is gradually enlarged from the sharp portion on the tip of the wall portion 1*b* toward the base end side, and a guide face 1*d* is jointed to the deflecting curved face 1*c*, thereby separating the water ejected in the direction of the arrow Z in FIG. 6 toward both sides and smoothly leading the water to the discharge port 1*a*. As shown in FIGS. 9A to 9C, moreover, the radius of curvature of the deflecting curved face 1*c* is gradually reduced from the upper portion of the deflector 1A toward the lower portion thereof, and the deflecting curved face 1*c* is gradually positioned on the forward side of the body A from the upper portion toward the lower portion. Thus, the water flow ejected from the water jet pump P can efficiently be directed to the discharge port 1*a*. As shown in FIGS. 9A to 9C and 10, fairing fins 1*h* and 1*k* extended horizontally from the wall portion 1*b* on the inner face 1*i* of the deflector 1A toward the discharge port 1*a* are formed in two stages above and below and serve to prevent the water flow, which is ejected from the steering nozzle 18, from being deflected into a vertical direction as much as possible, thereby positively deflecting the water flow toward the side (the discharge port 1*a* side).

As shown in FIGS. 4 and 9A to 9C, moreover, a rear edge 1*e* of the discharge port 1*a* is projected more toward the side (in the transverse direction) than a front edge 1*f*, and an inner face of the front edge 1*f* has a round curved shape such that the water flow can smoothly be directed toward the transom T side of the body A. As shown in FIGS. 3 and 5, furthermore, a fin in is formed horizontally (when going astern) on the outer surface of the deflector 1A for reinforcement and the rectifying function during backward movement.

As shown in FIG. 10, the relative vertical position of the steering nozzle 18 with respect to the deflector 1A is set such that the water flow ejected from the steering nozzle 18 is efficiently deflected toward the side in a state in which the deflector 1A is attached to the body A side. More specifically, in the embodiment, horizontal centerlines O18 and OA of the steering nozzle 18 and the deflector 1A are almost coincident with each other as shown in FIG. 10.

In the reverser 1, both corner portions of the stern (rear end) of the body A have larger round shapes than in the conventional PWC in a plane view such that the water flow discharged (ejected) from the discharge port 1*a* is fed toward the side along the transom T of the body A and is further fed forward along the side face of the body A as shown by arrows U1, U2 and U3 in FIG. 4.

The reverser 1 having such a structure functions in the following manner: In the case where the watercraft is to go in reverse, a reverse operation lever (not shown) is operated to the reverse mode side. Consequently, the deflector 1A as the reverser 1 is swung downward around the swinging shaft 1*m* so that a state shown in FIG. 10 is obtained.

When the water jet pump P is operated in this state, the water sucked from the suction port 17 provided on the bottom is ejected rearward from the pump nozzle 31 of the water jet pump P through the steering nozzle 18 provided behind the pump nozzle 31. As shown in FIG. 4, the ejected water flow comes in contact with the inner face 1*i* of the deflector 1A behind the steering nozzle 18 and is smoothly and efficiently deflected toward the side by means of the deflecting curved face 1*c*, the guide face 1*d*, the fairing fins 1*h* and 1*k* and the like. Consequently, the water flow is ejected from the discharge port 1*a* provided on the side of the deflector 1A. The water thus ejected flows toward the side along the transom T of the body A and further flows in the forward direction of the body A along the side face of the body A as shown in FIG. 4. For this reason, the water pressure is reduced more behind the portion of the transom T than in other portions of the body A. As a result, the body A is moved rearward. The sternward movement of the body A is also promoted by the reaction of the water flow on the side face of the body A in the forward direction. Consequently, the body A can go rearwardly more efficiently.

In the above-mentioned state, if the handle 21 is operated to turn the steering nozzle 18 rightward (see a direction of an arrow L in FIG. 4) from the center, for example, a larger amount of the water flow ejected from the steering nozzle 18 is fed by the wall portion 1*b* of the inner face 1*i* of the deflector A in a direction according to the degree the steering nozzle is moved. Thus, the personal watercraft can change direction when traveling rearwardly according to the degree the steering nozzle is turned. If the steering is performed to the right or left at the maximum, the water flow fed from the steering nozzle 18 comes in contact with only the right or left part of the wall portion 1*b* of the deflector 1A. Consequently, the water flow ejected from the steering nozzle 18 is discharged from only one of the discharge ports 1*a*. In this case, the reverser 1 also functions as a side thruster which has often been used for comparatively large ships. In other words, only the stern of the body A is moved to the right or left in the transverse direction. Accordingly, the personal watercraft can easily be brought alongside the pier.

As shown in FIG. 3, a plate-shaped member 30 can be provided below the discharge port 1*a* along the discharge port 1*a*. Therefore, a planing surface is retained. As a result, planing performance is enhanced.

In the personal watercraft according to the embodiment, it is not necessary to feed the water flow from the water jet pump P toward the bottom side when moving astern as described above. Therefore, the rear end of the bottom does not need to be hollowed out upward for the reverser but can be rectilinearly formed continuously from the forward region of the bottom as shown in FIGS. 5 and 10.

Consequently, the rear end of the bottom can function as the planing surface to obtain excellent planing performance during ordinary forward navigation.

While the personal watercraft has been described as an example in the embodiment, it is apparent that the reverser can also be applied to a larger planing typed watercraft.

Although the deflector has been swung around the swinging shaft and has been positioned behind the steering nozzle in the embodiment, it is apparent that other structures may be used, for example, the deflector may be operated rectilinearly in a vertical direction and be positioned behind the steering nozzle.

Numerous modifications and alternative embodiments of the invention will be apparent to those skilled in the art in view of the foregoing description. Accordingly, this description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A reverser for a watercraft having a transom and in which a deflector having two side portions is movably provided behind a pump nozzle of a water jet pump to change direction of the water flow ejected rearward from the pump nozzle, thereby moving the watercraft rearward said reverser comprising:

a discharge port opening in a transverse direction provided on both side portions of the deflector and spaced rearwardly of said transom, wherein an inner face of the deflector includes a wall portion vertically extended in the center thereof and a deflecting curved face, curved in a lateral direction relative the watercraft, is provided on both sides of the wall portion for deflecting the water flow ejected rearward in a transverse direction thereby feeding the water flow from the discharge port along said transom of the watercraft.

2. The reverser for a watercraft according to claim 1, wherein a guide face for smoothly directing the water flow to the discharge port is formed on the inner face of the deflector from the deflecting curved face toward the discharge port in a transverse direction.

3. The reverser for a watercraft according to claim 2, wherein a fairing fin horizontally extended in reverse state is projected onto the inner face of the deflector such that the water flow ejected from the steering nozzle is prevented from being deflected in a vertical direction and is smoothly directed toward a discharge port side.

4. The reverser for a watercraft according to claim 1 in combination with a watercraft wherein the watercraft has a rear end with two corner portions which are round-shaped as seen in a plan view.

5. The reverser in combination with a watercraft as in claim 4 wherein:

said transom of the watercraft is positioned close to the deflector and forward of the deflector.

6. The reverser in combination with a watercraft as in claim 5 wherein:

said deflector is positioned on said watercraft higher than a lower end of said transom.

7. A reverser for a watercraft having a transom and in which a deflector having two side portions is movably provided behind a pump nozzle of a water jet pump to change direction of the water flow ejected rearward from the pump nozzle, thereby moving a watercraft rearward, said reverser comprising:

a discharge port opening in a transverse direction provided on both side portions of the deflector wherein each deflector discharge port is turned toward said transom at an angle of about 5 to about 30 degrees as seen in a plan view, thereby feeding the waterflow from the discharge port along said transom of the watercraft.

8. A reverser for a watercraft in which a deflector having two side portions is movably provided behind a pump nozzle of a water jet pump to chance direction of the water flow ejected rearward from the pump nozzle, thereby moving the watercraft rearward, said reverser comprising:

a discharge port opening in a transverse direction provided on both side portions of the deflector, and wherein a lower end of the deflector has a partially circular shape as seen from the side and said discharge port is located in the middle portions of both side portions of the deflector only in the lower ends thereof, thereby feeding a water flow from the discharge port along a transom of the body of the watercraft.

9. A method of reversing a watercraft comprising:

reducing the pressure of water behind the watercraft relative the water pressure of water on other portions of the watercraft to thereby move the watercraft rearward.

10. The method of claim 9 wherein said watercraft is provided with a transom, a water jet pump and a pump nozzle for changing the direction of water flow ejected rearwardly of said transom by said jet pump and said step of reducing the pressure of water behind the watercraft further comprising:

deflecting most of the water ejected from said jet pump and pump nozzle in lateral directions adjacent to and rearward of said transom.

11. The method of claim 10 wherein said steps of deflecting further comprises the substep of:

deflection some of the water being deflected laterally also in a forward as well as lateral direction relative said watercraft.

12. The method of claim 10 wherein said watercraft is further provided with two corner portions on a rear end thereof which are round-shaped as seen in a plan view and said substep of deflecting some of said water includes deflecting some of said water laterally and forward around said corner portions of said watercraft.

13. A method of reversing a watercraft having a deflector movably provided behind a pump nozzle of a water jet pump to change direction of the water flow ejected rearward from the pump nozzle to move the watercraft in a rearward direction comprising:

deflecting most of the water ejected from said pump nozzle in lateral directions adjacent a transom at the rear end of said watercraft.

14. The method of claim 13 wherein said step of deflecting water ejected from said pump nozzle includes the substep of deflecting all of the water ejected from said pump nozzle in lateral directions adjacent said transom.

* * * * *